US009669325B2

(12) United States Patent
Li et al.

(10) Patent No.: US 9,669,325 B2
(45) Date of Patent: Jun. 6, 2017

(54) OMNI-DIRECTIONAL DYNAMIC TRACKING VIEWING SYSTEM

(71) Applicant: SHENZHEN OCT VISION INC., Shenzhen (CN)

(72) Inventors: Jian Li, Shenzhen (CN); Hongguang Wen, Shenzhen (CN); Baoluo Jia, Shenzhen (CN)

(73) Assignee: SHENZHEN OCT VISION INC., Shenzhen (CN)

( * ) Notice: Subject to any disclaimer, the term of this patent is extended or adjusted under 35 U.S.C. 154(b) by 0 days.

(21) Appl. No.: 15/108,210

(22) PCT Filed: Dec. 17, 2014

(86) PCT No.: PCT/CN2014/094016
§ 371 (c)(1),
(2) Date: Jun. 24, 2016

(87) PCT Pub. No.: WO2015/101178
PCT Pub. Date: Jul. 9, 2015

(65) Prior Publication Data

US 2016/0325201 A1 Nov. 10, 2016

(30) Foreign Application Priority Data

Dec. 30, 2013 (CN) ..... 2013 1 0742379

(51) Int. Cl.
*A63G 31/16* (2006.01)
*A63J 25/00* (2009.01)
*E04H 3/30* (2006.01)

(52) U.S. Cl.
CPC ..... *A63J 25/00* (2013.01); *A63G 31/16* (2013.01); *E04H 3/30* (2013.01)

(58) Field of Classification Search
CPC . A63G 1/00; A63G 1/10; A63G 19/00; A63G 19/20; A63G 31/00; A63G 31/16;
(Continued)

(56) References Cited

U.S. PATENT DOCUMENTS 4,885,878 A 12/1989 Wuu
5,114,154 A * 5/1992 Sellner ..... A63H 5/04 273/367
(Continued)

FOREIGN PATENT DOCUMENTS

CN 101025051 A 8/2007
CN 101930158 A 12/2010
(Continued)

OTHER PUBLICATIONS

The World Intellectual Property Organization (WIPO) International Search Report for PCT/CN2014/094016 Feb. 17, 2015.

*Primary Examiner* — Kien Nguyen
(74) *Attorney, Agent, or Firm* — Anova Law Group, PLLC

(57) ABSTRACT

The present invention discloses an omni-directional dynamic tracking viewing system, wherein, it comprises a spherical silver screen (600), a bracket (300) arranged in the spherical silver screen (600), a viewing platform (100) connected movably to the upper end of the bracket (300), and a projection device (400) arranged fixably onto the viewing platform (100); disposed on the viewing platform (100) are a plurality of rows of viewing seats (200); disposed on the viewing seats (200) are seat drive apparatuses used for driving the forward tilt or backward recline thereof; and disposed on the viewing platform (100) is a platform drive apparatus used for driving the rotation of same on the X axis,
(Continued)

Y axis, and Z axis. The present system allows dynamic movement of the film and television image, viewing angle, and viewing range.

13 Claims, 6 Drawing Sheets

(58) Field of Classification Search
CPC ..... A63H 33/00; A63H 33/22; G09B 9/00; G09B 9/12
USPC ..... 472/58–64, 75–80, 130; 52/6, 8; 434/29, 434/55
See application file for complete search history.

(56) References Cited

U.S. PATENT DOCUMENTS

| | | | | |
|---|---|---|---|---|
| 6,017,276 | A * | 1/2000 | Elson | A63G 31/16 434/29 |
| 6,665,985 | B1 * | 12/2003 | Hennes | E04H 3/22 352/69 |
| 2005/0014567 | A1 * | 1/2005 | Li | A63G 31/16 472/60 |
| 2010/0300006 | A1 | 12/2010 | Magpuri | |
| 2015/0065260 | A1 * | 3/2015 | Beyr | A63G 31/16 472/60 |

FOREIGN PATENT DOCUMENTS

| | | | |
|---|---|---|---|
| CN | 201673360 | U | 12/2010 |
| CN | 202548519 | U | 11/2012 |
| CN | 203223012 | U | 10/2013 |
| CN | 103711335 | A | 4/2014 |
| GB | 707877 | A | 4/1954 |

* cited by examiner

OMNI-DIRECTIONAL DYNAMIC TRACKING VIEWING SYSTEM

CROSS-REFERENCES TO RELATED APPLICATIONS

This application is a national stage application of PCT Patent Application No. PCT/CN2014/094016, filed on Dec. 17, 2014, which claims priority to Chinese Patent Application No. 201310742379.9, filed on Dec. 30, 2013, the content of all of which is incorporated herein by reference.

FIELD OF THE INVENTION

The present invention relates to the field of viewing apparatus, and more particularly, to an omni-directional dynamic tracking viewing system

BACKGROUND

In current technologies, a viewing platform is usually fixed, that is, after a viewer has sat down on a viewing platform, his watching angle is fixed, usually, he can only watch movie pictures in front of him, and his viewing range is also fixed, that is, the screen in front of him. However, at this time, the viewer is impossible to turn back to watch movies, thus for the viewing platforms in the prior art, their positions and angles for viewing are fixed, and they are impossible to achieve a function of dynamical movements.

Therefore, the current technology needs to be improved and developed.

BRIEF SUMMARY OF THE DISCLOSURE

According to the above described defects, the purpose of the present invention is providing an omni-directional dynamic tracking viewing system, in order to solve the problems of the viewing platforms in the prior art, that both positions and angles provided for viewing are fixed.

In order to achieve the above mentioned goals, the technical solution of the present invention to solve the technical problems is as follows:

An omni-directional dynamic tracking viewing system, wherein, it comprises a spherical silver screen, a bracket arranged in the spherical silver screen, a viewing platform connected movably to the upper end of the bracket, and a projection device arranged fixably onto the viewing platform; a plurality of rows of viewing seats are disposed on the viewing platform; seat drive apparatuses are disposed on the viewing seats, used for driving the forward tilt or backward recline thereof; and a platform drive apparatus is disposed on the viewing platform, used for driving rotations around the X axis, Y axis, and Z axis.

The said omni-directional dynamic tracking viewing system, wherein, the upper end of the bracket locates at the spherical center of the spherical sliver screen.

The said omni-directional dynamic tracking viewing system, wherein, the seat drive apparatus is an electric power driven apparatus, a hydraulic driven apparatus or a pneumatic driven apparatus.

The said omni-directional dynamic tracking viewing system, wherein, it further includes a telescope apparatus, applied to commute viewers to and from the viewing platform.

Benefits: the present invention connects a viewing platform movably to the upper end of a bracket, and arranges a platform drive apparatus on the said viewing platform, applied to drive the rotation of the viewing platform around all three axes, disposes a plurality of seat drive apparatuses on the viewing seats, applied to drive the viewing seats tilt forward or recline backward, and fixes a projection device onto the viewing platform, in such a way, the video output from the projection device will be projected to the facing spherical screen in a real time basis, following the rotation of the viewing platform, therefore, a dynamical adjustment of the video pictures following the platform will be achieved, and viewers may also be able to change their viewing angles and viewing ranges continuously.

DETAILED DESCRIPTION OF EMBODIMENTS

The present invention provides an omni-directional dynamic tracking viewing system, in order to make the purpose, technical solution and the advantages of the present invention clearer and more explicit, further detailed descriptions of the present invention are stated here, referencing to the attached drawings and some embodiments of the present invention. It should be understood that the detailed embodiments of the invention described here are used to explain the present invention only, instead of limiting the present invention.

Figure 1:
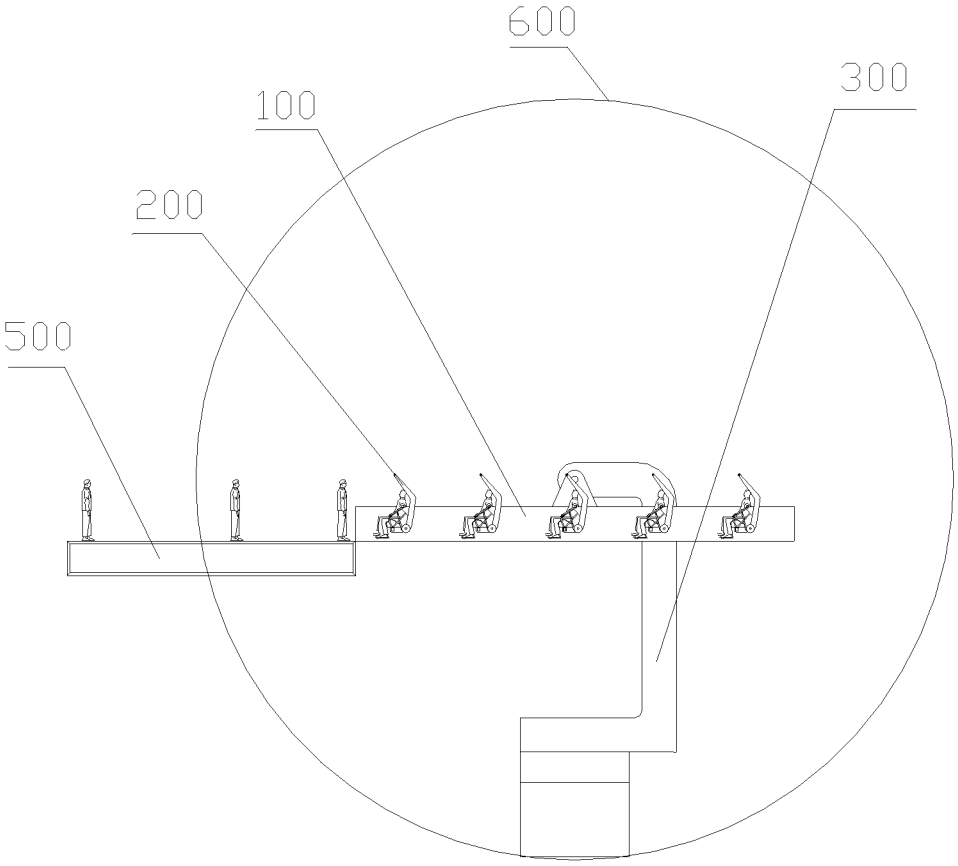
FIG. 1 illustrates a schematic diagram on a preferred embodiment of the omni-directional dynamic tracking viewing system after viewers have boarded the viewing platform, as provided in the present invention.
Figure 2:
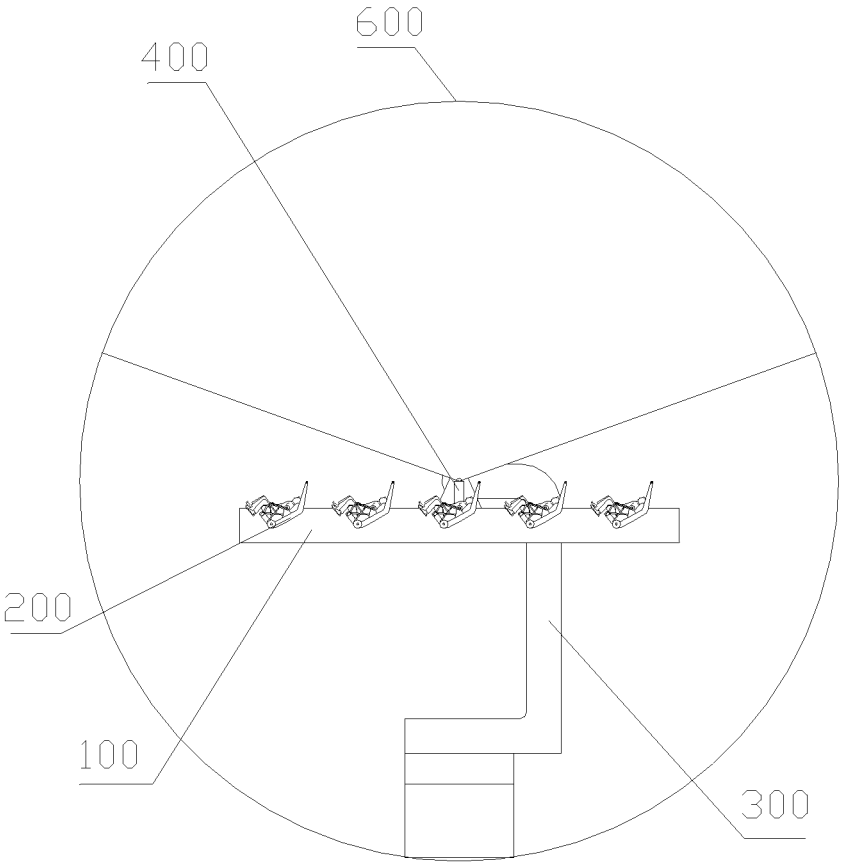
FIGS. 2-6 illustrate a series of schematic diagrams on the viewing platform described in the embodiment shown in FIG. 1 turning to different angles.
Figure 3:
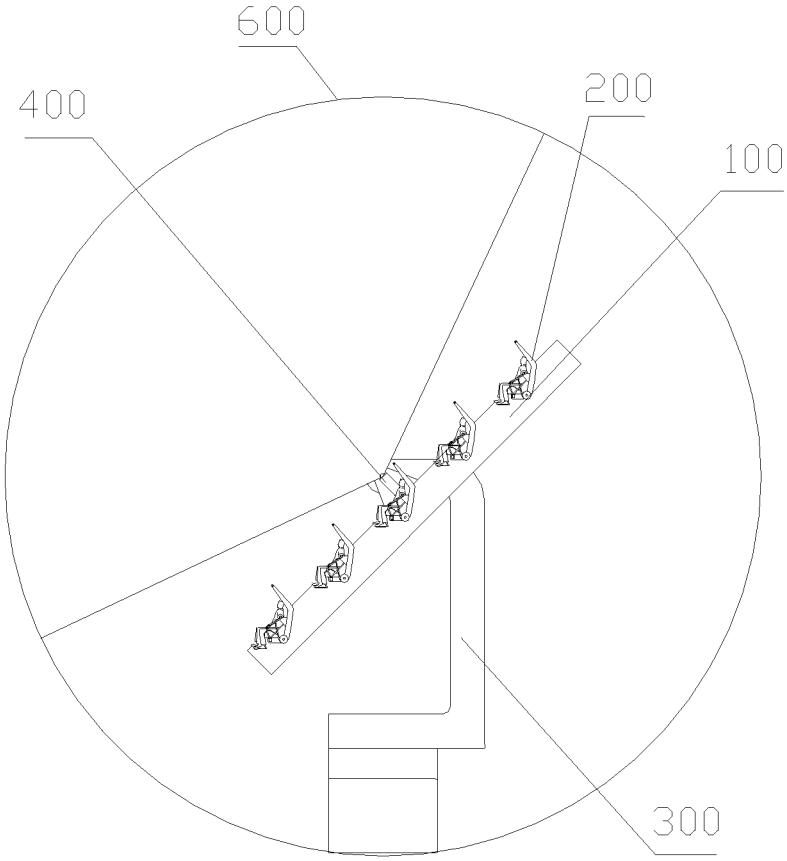
Figure 4:
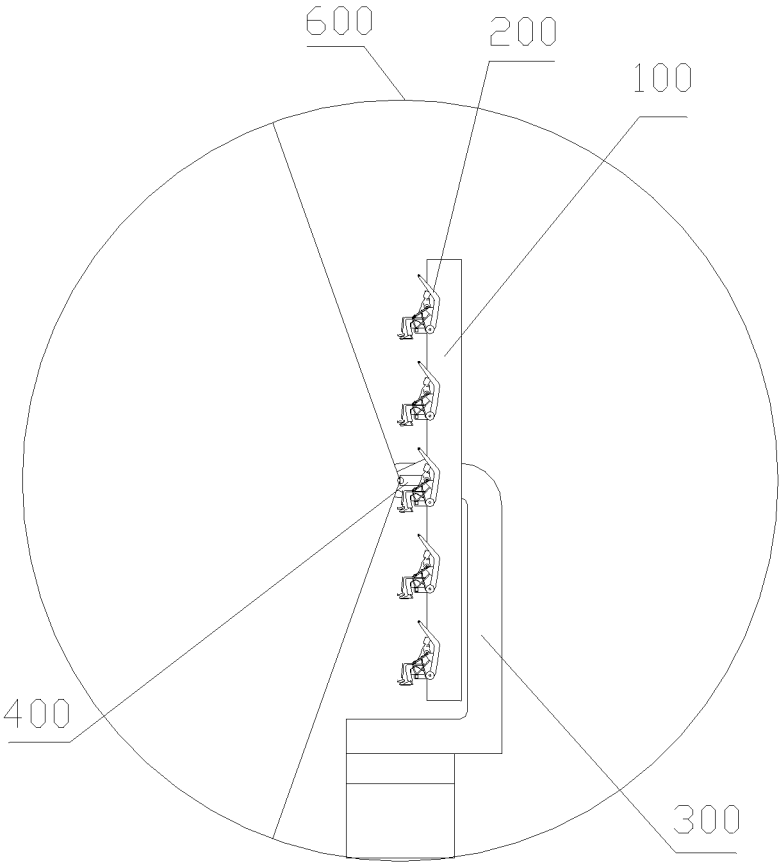
Figure 5:
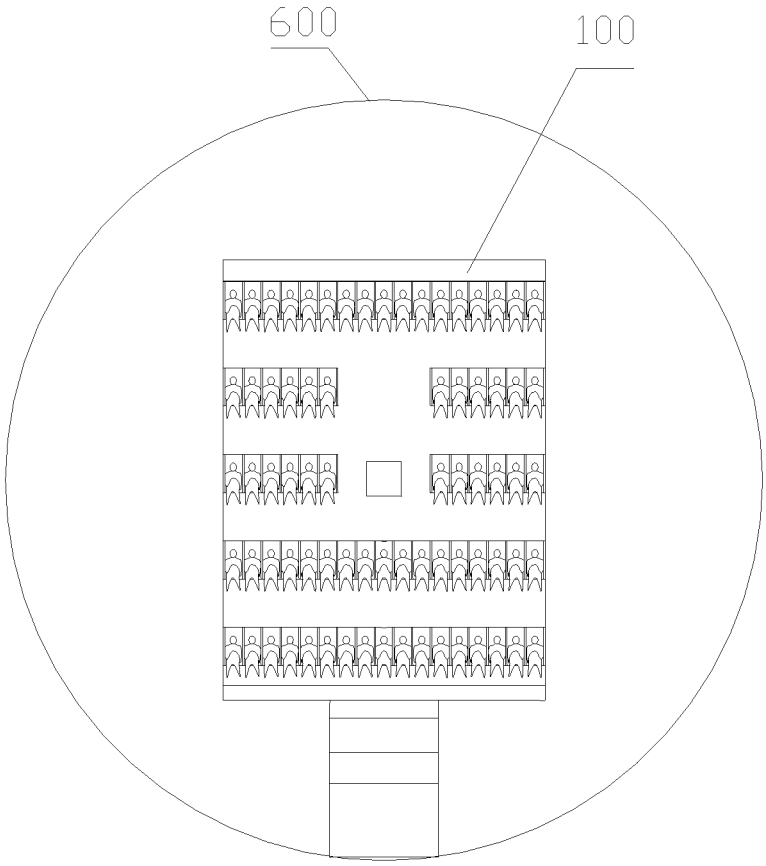
Figure 6:
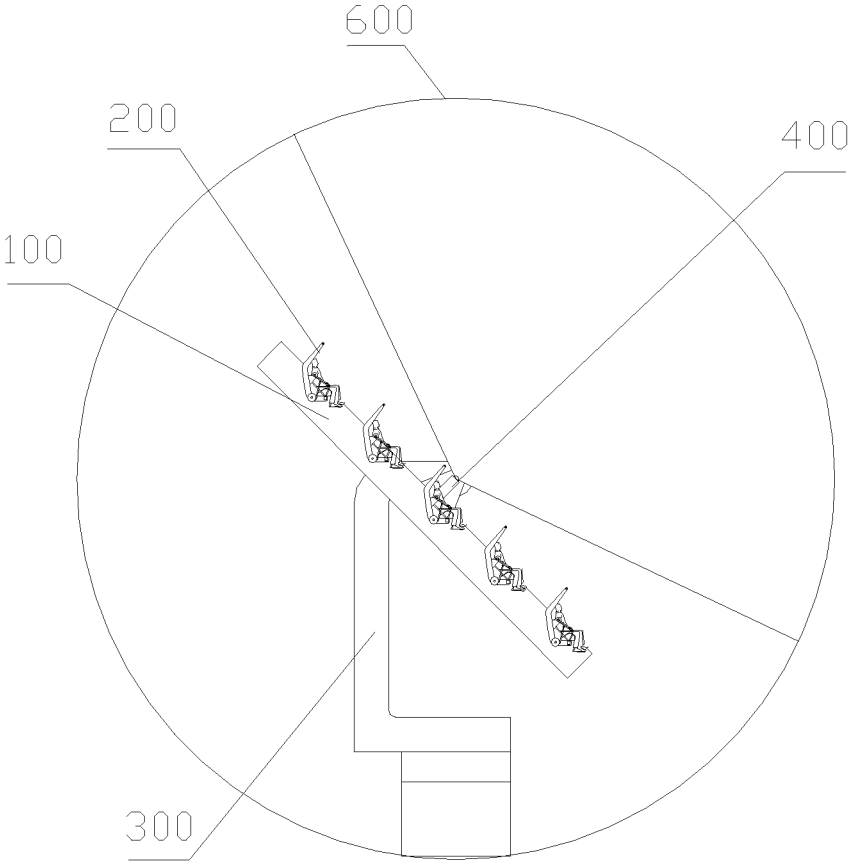

Referencing to FIG. 1, which illustrates a schematic diagram on a preferred embodiment of the omni-directional dynamic tracking viewing system after viewers have boarded the viewing platform, as provided in the present invention, as shown in the figure, it comprises a spherical silver screen 600, a bracket 300 arranged in the spherical silver screen 600, a viewing platform 100 connected movably to the upper end of the bracket 300, and a projection device 400 arranged fixably onto the viewing platform 100 (as shown in FIGS. 2-6 combining together), a plurality of rows of viewing seats 200 are disposed on the viewing platform 100; seat drive apparatuses are disposed on the viewing seats 200, used for driving the forward tilt or backward recline thereof; and a platform drive apparatus is disposed on the viewing platform 100, used for driving the rotation of same on the X axis, Y axis, and Z axis.

As shown in FIGS. 2-6, the viewing platform 100, as provided in the present invention, may rotate across the upper end of the bracket 300 in directions around the X axis, Y axis, and Z axis, thus make viewers be able to watch in all directions. The said viewing seats 200 may be arranged into 5 rows, or other numbers of rows according to any real requirements. However, when it is arranged into 5 rows, the first, fourth and fifth rows comprise 17 viewing seats each, while the second and the third rows comprise 6 viewing seats on each of left and right sides, and the projection device 400 is arranged at the center of the third row, which is also the center of the spherical silver screen 600.

In order to arrange all viewers on the viewing platform 100 locating at the center of the spherical silver screen 600, thus bringing all viewers a larger viewing range, the upper end of the said bracket 300 locates at the spherical center of the spherical silver screen 600

The seat drive apparatus as provided in the present invention may be an electric power driven apparatus, a hydraulic driven apparatus or a pneumatic driven apparatus.

Additionally, as shown in FIG. 1, it further includes a telescope apparatus 500 to commute viewers to and from the viewing platform 100, with the help of the said telescope apparatus 500, viewers may be sent to the viewing platform 100.

Wherein, the viewing platform may be designed as 15 meters high, and 10 meters wide, gaps between the viewing seats arranged in two sides of the second row and the third row are 2 meters, and gaps between seats in each row may be arranged into 0.5 meters or 1 meter. Wherein, the said seat drive apparatus further connects to a synchronization mechanism, applied to control the seat drive apparatus make synchronization actions, following the actions played in the video pictures from the projection device 400, for example, when the current video pictures shake from left to right, or shake from upper down, the synchronization mechanism will control the said seat drive apparatus swing from left to right, or swing from upper down, therefore, make the viewing seats generate the same actions, while the amplitude, frequency and more are synchronizing with the video pictures.

When the present invention is in use, viewers board onto the telescope device 500, then sit in the viewing seats 200 on the viewing platform 100, after tying seat-belts, and pressing safety levels, the viewing seats 200 will turn forward to an almost level position under the drive of the seat drive apparatus, now the projection device 400 locates at the center of the spherical silver screen 600, both the pivot and rotation points of the viewing platform 100 locate at the center of the spherical silver screen 600, then the projection device 400 plays videos, and pictures are locating right on top of the viewers, the viewing platform 100 may turn lower to a maximum of 90 degrees, according to the scenes in the movie, and may rotate n*360 degrees around the Z axis at the same time, since the projection device 400 is fixed onto the viewing platform 100, the video pictures may be projected onto the facing spherical silver screen 600 in a real time basis, following the rotation and revolution of the viewing platform 100, while the viewing seats 200 keep in a vertical position at most time, except for making self-rotations, however, when needed, they may also make pitching actions according to the contents of the movie, and finally they will go back to their original positions after the movie ends.

All above, the present invention connects a viewing platform movably to the upper end of a bracket, and arranges a platform drive apparatus on the said viewing platform, applied to drive the rotation of the viewing platform around all three axes, disposes a plurality of seat drive apparatuses on the viewing seats, applied to drive the viewing seats tilt forward or recline backward, and fixes a projection device onto the viewing platform, in such a way, the video output from the projection device will be projected to the facing spherical screen in a real time basis, following the rotation of the viewing platform, therefore, a dynamical adjustment of the video pictures following the platform will be achieved, and viewers may also be able to change their viewing angles and viewing ranges continuously.

It should be understood that, the application of the present invention is not limited to the above examples listed. Ordinary technical personnel in this field can improve or change the applications according to the above descriptions, all of these improvements and transforms should belong to the scope of protection in the appended claims of the present invention.

What is claimed is:

1. An omni-directional dynamic tracking viewing system, wherein, it comprises a spherical silver screen, a bracket arranged in the spherical silver screen, a viewing platform connected movably to an upper end of the bracket, a pivot of the viewing platform being located at the center of the viewing platform, and a projection device arranged fixably onto the viewing platform; a plurality of rows of viewing seats are disposed on the viewing platform; seat drive apparatuses are disposed on the viewing seats, used for driving the forward tilt or backward recline thereof; and a platform drive apparatus is disposed on the viewing platform, used for driving rotations around the X axis, Y axis, and Z axis.

2. The omni-directional dynamic tracking viewing system according to claim 1, wherein, the upper end of the bracket locates at the spherical center of the spherical sliver screen.

3. The omni-directional dynamic tracking viewing system according to claim 1, wherein, the seat drive apparatus is an electric power driven apparatus, a hydraulic driven apparatus or a pneumatic driven apparatus.

4. The omni-directional dynamic tracking viewing system according to claim 1, wherein a rotation point of the viewing platform is located at the center of the spherical silver screen.

5. The omni-directional dynamic tracking viewing system according to claim 1, wherein the viewing platform is configured to turn lower to a maximum of 90 degrees and to rotate n*360 degrees around the Z axis at the same time.

6. The omni-directional dynamic tracking viewing system according to claim 1, wherein the viewing seats are configured to make a pitching action.

7. An omni-directional dynamic tracking viewing system, comprising: a spherical silver screen, a bracket arranged in the spherical silver screen, a viewing platform connected movably to an upper end of the bracket, a projection device arranged fixably onto the viewing platform, and a telescope apparatus applied to commute viewers to and from the viewing platform; wherein a plurality of rows of viewing seats are disposed on the viewing platform; seat drive apparatuses are disposed on the viewing seats, used for driving the forward tilt or backward recline thereof; and a platform drive apparatus is disposed on the viewing platform, used for driving rotations around the X axis, Y axis, and Z axis.

8. The omni-directional dynamic tracking viewing system according to claim 7, wherein a pivot of the viewing platform is located at the center of the viewing platform.

9. The omni-directional dynamic tracking viewing system according to claim 7, wherein a rotation point of the viewing platform is located at the center of the spherical silver screen.

10. The omni-directional dynamic tracking viewing system according to claim 7, wherein the upper end of the bracket locates at the spherical center of the spherical sliver screen.

11. The omni-directional dynamic tracking viewing system according to claim 7, wherein, the seat drive apparatus is an electric power driven apparatus, a hydraulic driven apparatus or a pneumatic driven apparatus.

12. The omni-directional dynamic tracking viewing system according to claim 7, wherein the viewing platform is configured to turn lower to a maximum of 90 degrees and to rotate n*360 degrees around the Z axis at the same time.

13. The omni-directional dynamic tracking viewing system according to claim 7, wherein the viewing seats are configured to make a pitching action.

* * * * *